US006076941A

United States Patent [19]

Hass et al.

[11] Patent Number: 6,076,941

[45] Date of Patent: Jun. 20, 2000

[54] CONNECTOR ASSEMBLY, IN PARTICULAR FOR MAKING CONTACT WITH A GAS DISCHARGE LAMP

[75] Inventors: Jürgen Hass, Erzhausen; Edgar Herth, Langen, both of Germany

[73] Assignee: The Whitaker Corporation, Wilmington, Del.

[21] Appl. No.: 09/068,434

[22] PCT Filed: Nov. 22, 1996

[86] PCT No.: PCT/IB96/01290

§ 371 Date: May 11, 1998

§ 102(e) Date: May 11, 1998

[87] PCT Pub. No.: WO97/22168

PCT Pub. Date: Jun. 19, 1997

[30] Foreign Application Priority Data

Dec. 14, 1995 [DE] Germany ..... 195 46 797

[51] Int. Cl.[7] ..... F21K 27/00

[52] U.S. Cl. ..... 362/263; 362/226; 362/375; 439/239; 439/375; 439/617; 439/753; 439/619; 439/140; 439/141; 439/337

[58] Field of Search ..... 362/226, 263, 362/374, 375; 439/239, 375, 558, 617, 753, 615, 619, 140, 141, 336, 337, 671, 672, 783, 780, 146, 786

[56] References Cited

U.S. PATENT DOCUMENTS

| | | | |
|---|---|---|---|
| 4,768,966 | 9/1988 | Doherty | 439/137 |

FOREIGN PATENT DOCUMENTS

| | | | |
|---|---|---|---|
| 25 12 991 | 9/1976 | Germany | H01R 33/08 |
| 29 38 247 | 10/1980 | Germany | H01R 33/08 |
| 43 12 776-A1 | 12/1994 | Germany | H01R 33/08 |
| WO 87/04867 | 8/1987 | WIPO | H01R 33/96 |

*Primary Examiner*—Cassandra Spyrou
*Assistant Examiner*—Leo Boutsikaris

[57] ABSTRACT

A connector assembly, in particular for making contact with gas discharge lamps, is specified which is safe in operation even with the lamp not having been introduced. The assembly has a housing made of a dielectric material, having a central contact and having an outer contact. A rotatable sleeve made of a dielectric material is situated in the housing. The sleeve can be rotated by means of at least one lug fitted on the outer periphery of the base of the gas discharge lamp. A tongue which moves from a first position to a second position when the gas discharge lamp is screwed in is fitted on the rotatable sleeve. The tongue opens or closes an electrical circuit, or actuates a switch.

5 Claims, 4 Drawing Sheets

D-D

C-C

A-A

B-B

CONNECTOR ASSEMBLY, IN PARTICULAR FOR MAKING CONTACT WITH A GAS DISCHARGE LAMP

BACKGROUND OF THE INVENTION

1. Field of the Invention

The invention relates to a connector assembly, for making contact with a gas discharge lamp, having a housing made of a dielectric material, having a central contact and an outer contact.

2. Summary of the Prior Art

In order to make contact with gas discharge lamps, the gas discharge lamp is plugged into a housing and turned. Two lugs on the base of the gas discharge lamp engage behind a bead on the housing and secure it. An outer contact and a central contact are required for making contact with the gas discharge lamp. Since high voltage is required for operating these lamps, it is important that this voltage is not already present across the contacts when a gas discharge lamp has not yet been inserted, in other words that it is ensured that a person cannot reach into a holder for such a lamp and be injured.

SUMMARY OF THE INVENTION

From WO 87/04867 a safety lamp holder for receiving a bayonet bulb is known. In this lamp holder structure a rotatable sleeve is used in combination with a switching device for interrupting the electrical circuit. A contact carrier with a contact is mounted within a body which defines slots for the bayonet pins of the light bulb, the contact carrier being movable relative to the body between first and second positions. Contact to the terminal pins is made in one of the positions and in the other position there is no contact made to the terminal pins.

From GB 14 81 110 a safety device for an electrical lamp holder is described. The lamp is screwed into the lamp holder and by being inserted moves a plastic part which interrupts the contact of the lamp contacts to the terminals. This arrangement may be also used with high voltages.

SUMMARY OF THE INVENTION

The object of the invention is to specify a connector assembly, for making contact with a gas discharge lamp, which is safe in operation even in the absence of the gas discharge lamp and is proof against a voltage of 1000 V.

The object is achieved by means of an assembly having the features of patent claim 1. Advantageous developments are specified in the subclaims.

A connector assembly, for making contact with a gas discharge lamp, is specified which has an integrated switch.

The use for a gas discharge lamp is particularly advantageous. The switch ensures that high voltage is present across the contacts of the holder only when the gas discharge lamp is inserted. This can be achieved by providing, in the housing of the holder, a rotatable sleeve which is rotated by at least one of the lugs on the outer periphery of the base of the gas discharge lamp. On this rotatable sleeve, it is possible to provide a tongue by which an electrical circuit is interrupted or closed again.

Such an arrangement with a rotatable sleeve additionally oversees that the gas discharge lamp is screwed into the holder and secured there, rather than just being plugged into said holder.

It is particularly important for the switch provided in the arrangement to be proof against a voltage of 1000 V. This can be achieved, by virtue of the fact that the tongue which is fastened to the rotatable sleeve and is produced from a dielectric material is brought between two parts of the electrical circuit. It is particularly advantageous for parts of the electrical circuit to be of a resilient design in order to facilitate the introduction of the tongue between the spring and the further contact.

BRIEF DESCRIPTION OF THE DRAWING

FIG. 4 shows a view from below of the assembly according to the invention without the cover having been put on;

DETAILED DESCRIPTION OF THE PREFERRED EMBODIMENT

Figure 1:
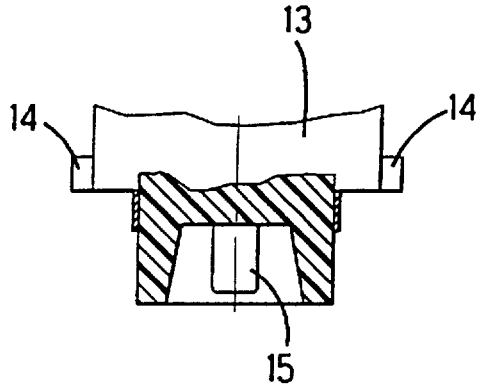
FIG. 1 shows a partial view with a partial cross section of a base of a gas discharge lamp.

FIG. 1 shows a partial view of a base of a gas discharge lamp 13 having lugs 14 fitted on the outer periphery, and having a central contact 15.

Figure 2:
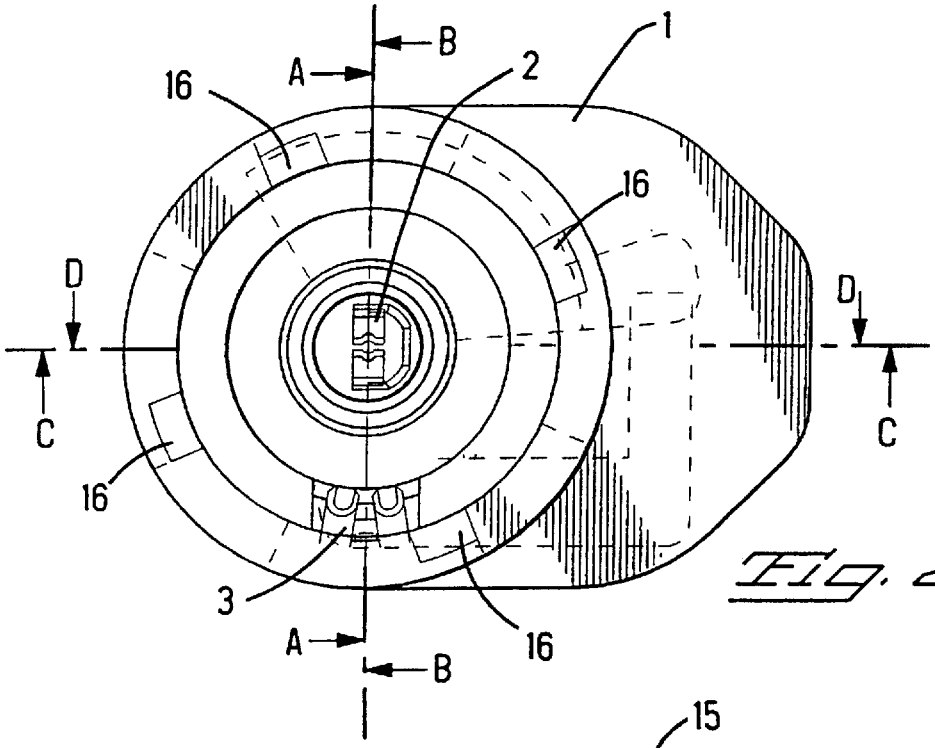
FIG. 2 shows a plan view of an assembly according to the invention.
Figure 3:
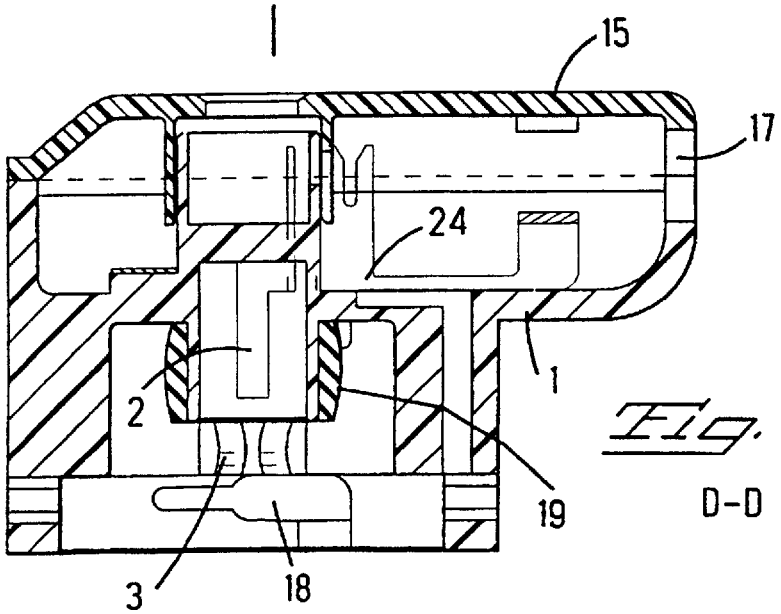
FIG. 3 shows a section according to the section line DD in FIG. 2.
Figure 4:
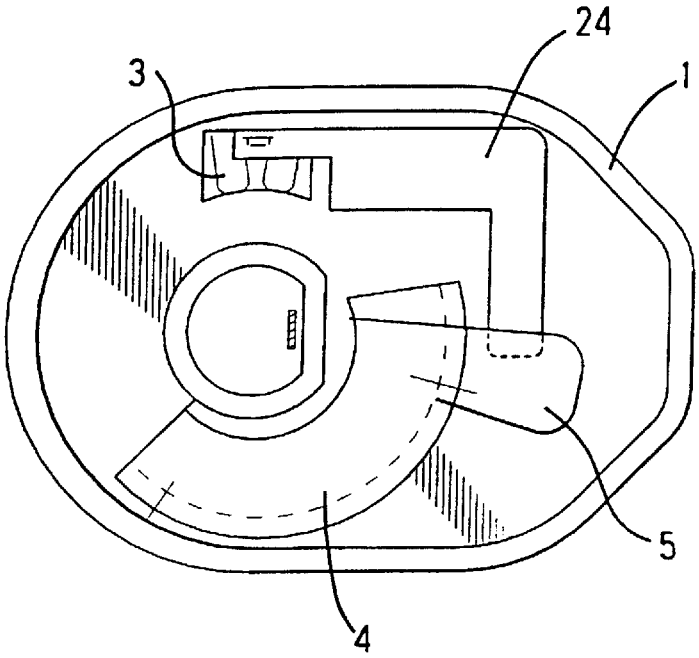
Figure 5:
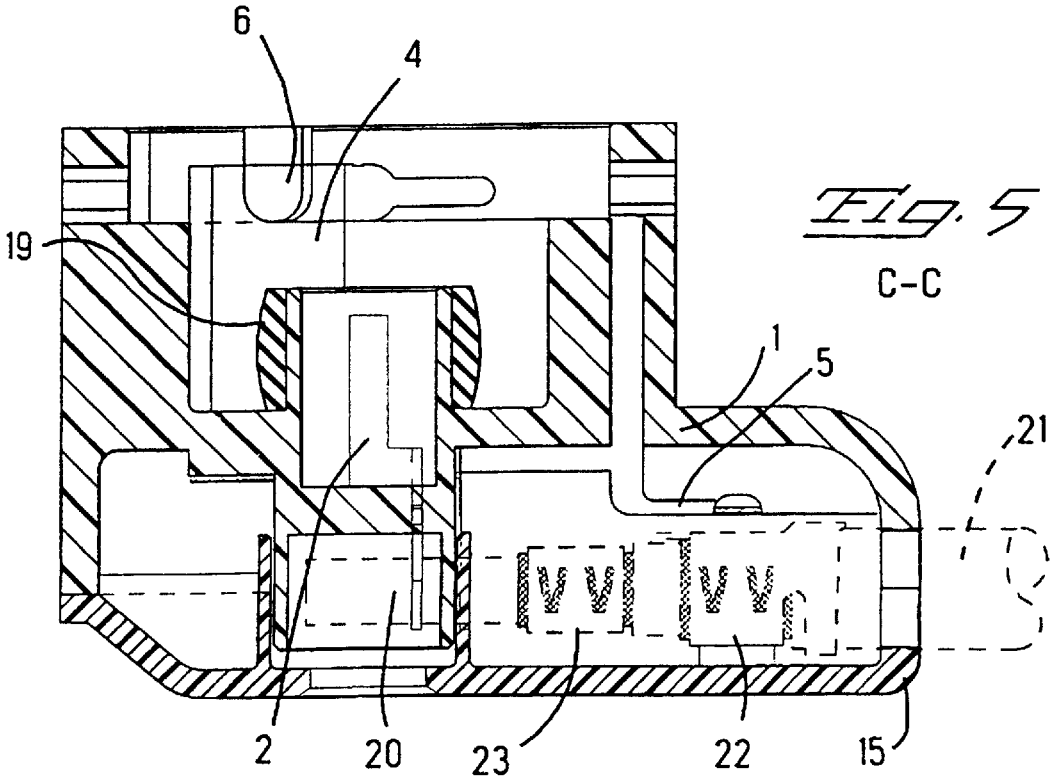
FIG. 5 shows a section along the section line CC in FIG. 2.
Figure 6:
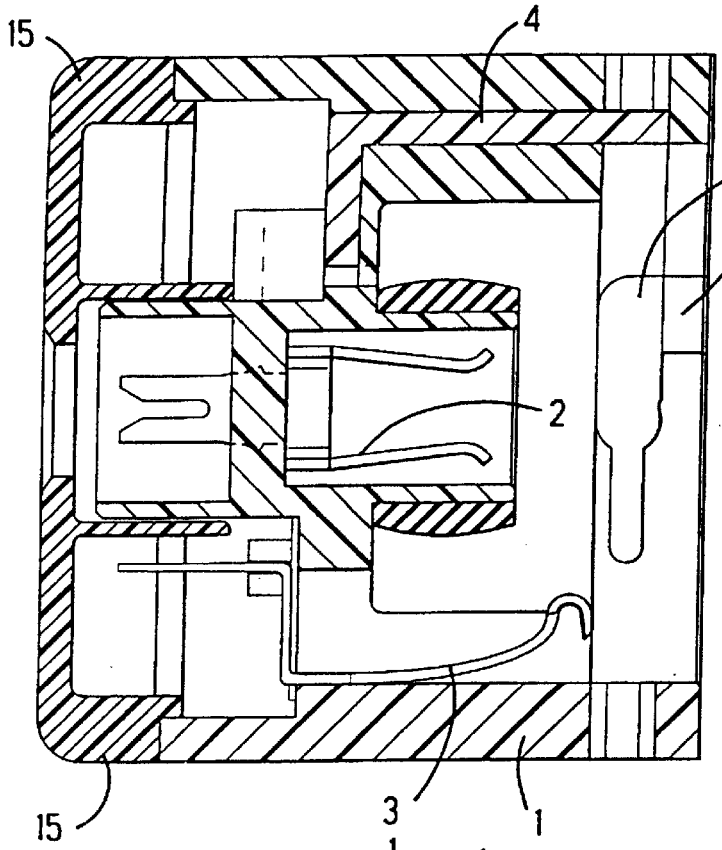
FIG. 6 shows a section along the section line AA in FIG. 2.
Figure 7:
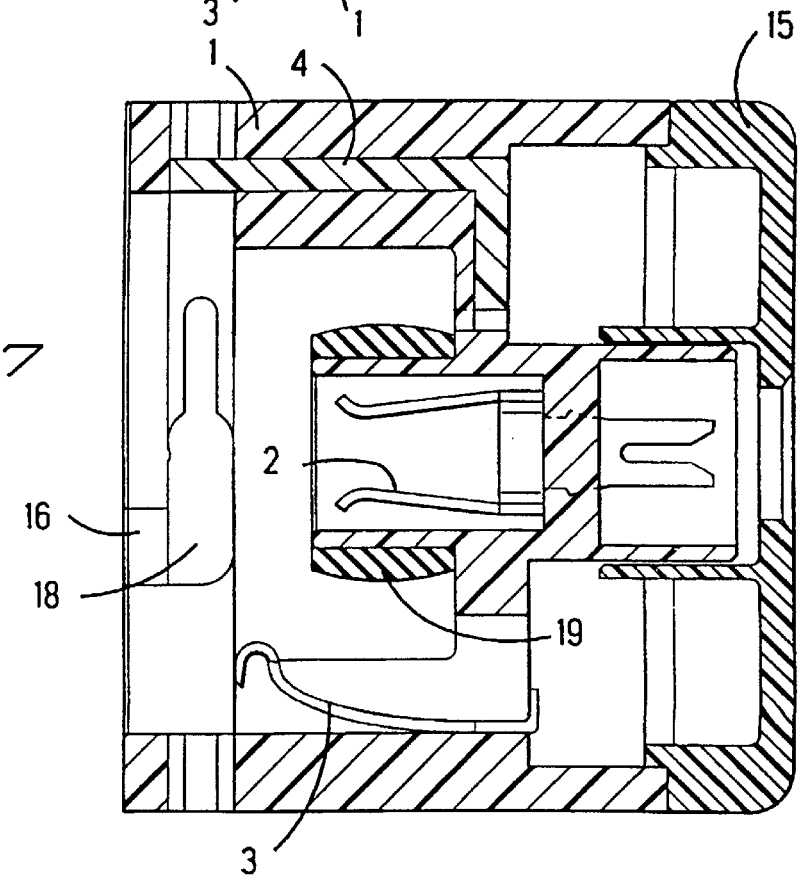
FIG. 7 shows a section along the section line BB in FIG. 2.

FIGS. 2–10 illustrate a first exemplary embodiment of the invention with a rotatable sleeve. FIG. 2 shows a plan view of the housing 1. The housing essentially consists of a cylindrical part having a housing base and a part which projects radially or axially from this cylindrical part and through which the supply lead into the housing is introduced. The way in which the supply lead is introduced can be seen particularly easily in FIG. 5, in which a cable 21 is illustrated using dashed lines. It is also easy to see the housing 1 and the housing cover 15, which is put onto the housing from below, that is to say from the side facing away from the gas discharge lamp. In FIG. 2, four openings 16 into which the lugs 14 of the holder of the gas discharge lamp can be introduced can clearly be seen. Furthermore, the central contact 2 and the cuter contact 3 can be seen. The outer contact 3 consists of two resilient tongues. It is evident from FIG. 3 that the housing 1 has a cover 15 and left between the two is a through opening 17 for the introduction of the cable. Furthermore, the central contact 2 and the outer contact 3 can be seen in FIG. 3. It is also possible to see the link 18, in which the lugs 14 of the gas discharge lamps 13 are guided. Furthermore, it is possible to see a seal 19 which is inserted between the gas discharge lamp and the housing in order to protect the central contact and reliably retain the gas discharge lamp. The rotatable sleeve 4 with the tongue 5 fitted thereon can be seen for the first time in FIG. 4. In addition, the contact-making strip 24 originating from the outer contact 3 is clearly visible. Said strip is shown with a dot-dashed line in FIG. 2 and is also visible in FIG. 3. FIG. 5 shows the rotatable sleeve 4 with the tongue 5 particularly clearly. The cutout 6 into which the lug 14 of the gas discharge lamp 13 can be introduced can easily be seen. In addition, the way in which the triaxial lead 21 is introduced into the housing can be seen in this illustration. The inner conductor 20 is connected to the central contact 2. There are also two contact-making regions 22 and 23, one for the outer conductor and one for the center conductor of the coaxial lead 21. The sections in FIGS. 6 and 7 once again clearly show the structure of the entire housing.

Figure 8:
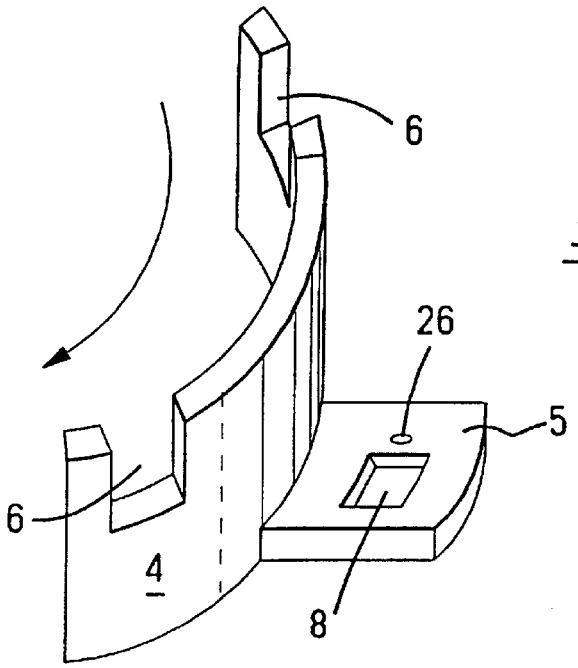
FIG. 8 shows a diagrammatic illustration of the sleeve.
Figure 9:
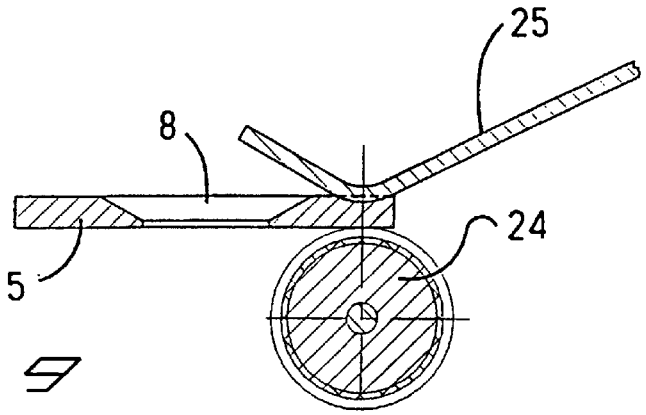
FIG. 9 shows a diagrammatic illustration of the open switch.
Figure 10:
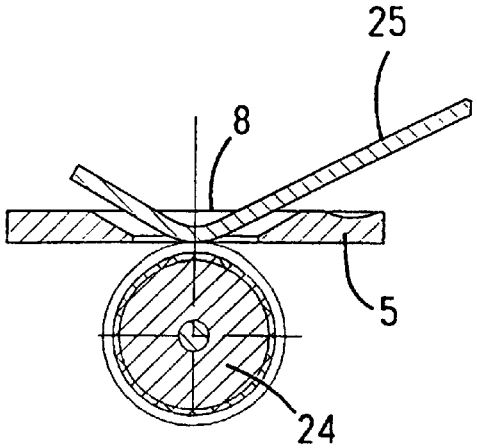
FIG. 10 shows a diagrammatic illustration of the closed switch.

FIGS. 8–10 again illustrate diagrammatically the method of operation of the arrangement with an exemplary switching function. FIG. 8 shows the sleeve having the cutouts 6 and an opening 8 in the tongue 5. It can clearly be seen here that the sleeve does not have to be a cylindrical one, but rather that a rotatable part, such as a sleeve section, for example, is completely sufficient. A resilient metal tab 25 is shown for making contact with a part of a cable 24. If the lamp is not introduced, then the resilient metal tab is situated in a depression 26 in the tongue 5 of the rotatable sleeve 4. If a lamp is plugged in and the rotatable sleeve 4 is turned, then the spring 25 reaches through the opening 8 in the tongue and makes contact with the cable 24. The switching function can also take place the other way round, that is to say the switch is open when the lamp is introduced, and is otherwise closed.

We claim:

1. A connector assembly for making contact with a gas discharge lamp, comprising a housing made of a dielectric material, a central contact and an outer contact spaced from the central contact to receive the gas discharge lamp when inserted in the housing, a rotatable sleeve in the housing that is rotated by a lug fitted on the outer periphery of the gas discharge lamp between a first position in which an electrical circuit through the gas discharge lamp is established and a second position in which the electrical circuit is interrupted, the sleeve has a cutout into which the lug of the gas discharge lamp can be introduced and a tongue that when the rotatable sleeve is in the second position the tongue extends between two parts of the electrical circuit to interrupt the electrical circuit, and wherein the tongue is brought from one position to the other as a result of turning of the gas discharge lamp which turns the sleeve and thereby moves the tongue.

2. The assembly as claimed in claim 4, wherein the tongue has an opening and a resilient metal tab forms part of the electrical circuit, this resilient metal tab producing a contact through the opening in one position on the tongue.

3. The assembly as claimed in claim 4, wherein the rotatable sleeve is arranged to secure the gas discharge lamp when screwed in.

4. The assembly as claimed in claim 5 wherein the rotatable sleeve is arranged to secure the gas discharge lamp when screwed in.

5. A connector assembly for making contact between cables and a gas discharge lamp having lugs extending therefrom, the connector assembly comprising: a housing with openings continuous with a transverse link for receiving the lugs of the gas discharge lamp to retain the gas discharge lamp within the housing; the housing further including a central contact and an outer contact spaced therefrom to engage the gas discharge lamp and form an electrical circuit therewith; and a rotatable sleeve displaceable between first and second position that is located in the housing and includes cutouts that align with the openings in the second position for also receiving the lugs and being rotatable into the first position as the lugs would travel within the transverse links, where a tongue is included as part of the rotatable sleeve that in the second position interrupts the electrical circuit.

* * * * *